United States Patent [19]

Savage

[11] Patent Number: 4,813,398

[45] Date of Patent: Mar. 21, 1989

[54] CONVECTION OVEN

[75] Inventor: James A. Savage, Huber Heights, Ohio

[73] Assignee: Hobart Corporation, Troy, Ohio

[21] Appl. No.: 191,467

[22] Filed: May 9, 1988

[51] Int. Cl.[4] ..... F24C 15/32

[52] U.S. Cl. ..... 126/21 A; 126/39 C; 126/273 R; 165/125; 432/152; 432/176; 432/199; 99/447; 99/474

[58] Field of Search ..... 126/21 A, 21 R, 19 R, 126/39 C, 273 R, 39 R, 91 A, 20; 99/473, 477, 446, 443 R, 474, 447, 475; 34/196, 219, 220, 231; 432/176, 199, 152; 165/125; 219/400

[56] References Cited

U.S. PATENT DOCUMENTS

| | | | |
|---|---|---|---|
| 1,874,328 | 8/1932 | McCutcheon | 432/176 |
| 2,235,559 | 3/1941 | Mayer | 432/176 |
| 3,605,717 | 9/1971 | Sauer | 126/21 A |
| 3,926,106 | 12/1975 | Deusing et al. | 99/447 |
| 3,977,387 | 8/1976 | Lawler | 126/21 A |
| 4,484,561 | 11/1984 | Baggott | 126/21 A |
| 4,516,012 | 5/1985 | Smith et al. | 126/21 A |
| 4,627,409 | 12/1986 | Kagomoto | 126/21 A |
| 4,648,377 | 3/1987 | Van Camp | 126/21 A |
| 4,753,215 | 6/1988 | Kaminski et al. | 99/447 |

FOREIGN PATENT DOCUMENTS

| | | | |
|---|---|---|---|
| 2339446 | 2/1975 | Fed. Rep. of Germany | 126/21 A |
| 2109920 | 6/1983 | United Kingdom | 126/21 A |

*Primary Examiner*—James C. Yeung
*Attorney, Agent, or Firm*—Russell L. McIlwain

[57] ABSTRACT

A gas-fired convection oven comprises a cooking cavity having a centrifugal fan mounted on a rear wall thereof. A vertical shroud mounted adjacent to the fan forms a narrow heat exchanging chamber within the cavity. A heat exchanger comprising a generally U-shaped hollow tube extends within the heat exchanging chamber and is provided with outwardly directed jets on the leg portions thereof. A power jet burner surrounded by a secondary air passageway conduit communicate with an inlet into the heat exchanger. Means for baffling secondary air at the inlet to the heat exchanger provides for generally balanced flow of combustion products within both legs of the heat exchanger facilitating energy efficiency in the heating of the cooking cavity.

8 Claims, 5 Drawing Sheets

CONVECTION OVEN

BACKGROUND OF THE INVENTION

1. Field of the Invention

The present invention relates generally to an improved gas-fired convection oven, and it relates more particularly to a convection oven having substantially improved heating efficiency over prior art ovens.

2. Description of the Prior Art

A popular type of oven for use in commercial cooking and baking applications is a gas-fired convection oven. The gas-fired convection oven typically includes an insulated enclosure defining a cooking cavity having access in the form of one or more hinged forwardly facing doors. In the rear of the cavity is mounted a motor-operated fan adapted to circulate cavity air across a heat exchanger. The heat exchanger typically comprises a hollow tube constructed to receive a preselected mixture of natural gas and air admitted into the tube from a burner and secondary air supply conduit. When the burner is ignited, heat generating combustion by-products flow into the heat exchanger and air circulated over the heat exchanger walls is directed into the cavity for cooking or baking food products placed therein. An example of the foregoing oven is disclosed in U.S. Pat. No. 4,648,377 issued Mar. 10, 1987 to Van Camp and assigned to the assignee hereof. As shown therein, the heat exchanger may consist of a hollow tube positioned proximate the rear wall of the oven cavity with the circulating fan disposed centrally thereof. A shroud may be mounted in front of the heat exchanger such that intake air is admitted to the fan through a central shroud opening and is circulated back into the oven cavity through space provided between the shroud edges and the walls of the oven cavity.

Convection ovens of the foregoing type offer considerable advantages over non-convection devices in that cooking times can be substantially reduced. A forced-air system results in heat transfer to the product by means of turbulent air flow across the product surfaces thereby enhancing the rate of heat transfer to the product. Thus, convection ovens have proved to be an important advancement in the food preparation art. However, a disadvantage of known convection ovens resides in their inability to cook or bake food products with uniform surface characteristics and doneness. Lack of uniformity in surface characteristics or doneness can result, for example, from disparate or unequal pressure zones within the cooking cavity due to air flow characteristics of the fan and cavity. It would therefore be desirable to provide a convection oven which exhibits substantially uniform cooking results. Moreover, it would be further desirable to provide a convection oven having greater heat transfer efficiency than presently known oven units, whereby the oven can be operated with reduced gas consumption and greater energy efficiency.

SUMMARY OF THE INVENTION

Briefly, there is provided in accordance with the teachings of the present invention a new and improved gas-fired convection oven comprising a cooking cavity with a centrifugal fan mounted on a rear wall thereof. A vertical shroud is mounted adjacent the side of the fan opposite of the rear wall of the cavity thereby forming a relatively narrow heat exchanging chamber within the cavity. A heat exchanger comprising a generally U-shaped hollow tube extends along the bottom and sides of the chamber and has a combustion by-products inlet entering to it along the bottom extent thereof. The inlet is in fluid communication with a conduit which, in turn, extends through the rear wall of the cavity. The conduit is square in cross-section and houses a centrally positioned burner tube with sufficient space around the tube as to define a secondary air passageway. A blower communicating with the conduit provides a supply of secondary air through the passageway to the heat exchanger for proper combustion of the gas issuing from the burner.

It has been found that with the structural arrangement heretofore described combustion by-products entering the heat exchanger from the secondary air passageway and burner tube are unevenly distributed to the two legs of the heat exchanger. To overcome this uneven air distribution, in accordance with one aspect of this invention, the conduit is partially baffled such that a secondary air opening is formed offset to one side of the burner tube. The offset arrangement of the conduit opening appears to create a condition wherein air is directed into the heat exchanger adjacent one leg thereof thereby causing a relative high pressure air zone which resists the passage of excessive combustion by-products to that leg of the heat exchanger. By properly configuring the baffle, both legs of the heat exchanger may thereby receive approximately equal portions of combustion air and gas such that uniform heating of the heat exchanger is possible. This results in better heat distribution throughout the heat exchanging chamber.

It has further been found that the unidirectional nature of the centrifugal air circulating fan creates a condition whereby high pressure and low pressure zones are present in the cooking cavity of the oven. These zones would tend to cause non-uniform cooking or baking of food products placed in the cavity unless compensated for. Thus, in accordance with another aspect of the invention, the shroud is provided with a pair of semi-circular baffles positioned within the heat exchanging chamber in proximity to the blades of the fan and mounted to the shroud on diametrically opposite sides of the central fan intake opening. These baffles are provided with apertures such that they restrict the flow of air from the fan in the direction of the corners of the cavity wherein high pressure air zones would otherwise exist. The air pressure and flow within the cavity is thereby balanced and uniform cooking results are achieved. Both aforementioned aspects of the invention cooperate to provide a convection oven which is highly energy efficient by reason of the improved heat transfer characteristics of the heat exchanger and of the uniformly pressurized air flow within the cooking cavity.

BRIEF DESCRIPTION OF THE DRAWINGS

The foregoing and other novel features of the present invention will be better understood by a reading of the following detailed description taken in connection with the accompanying drawings wherein.

DETAILED DESCRIPTION OF THE INVENTION

Figure 1:
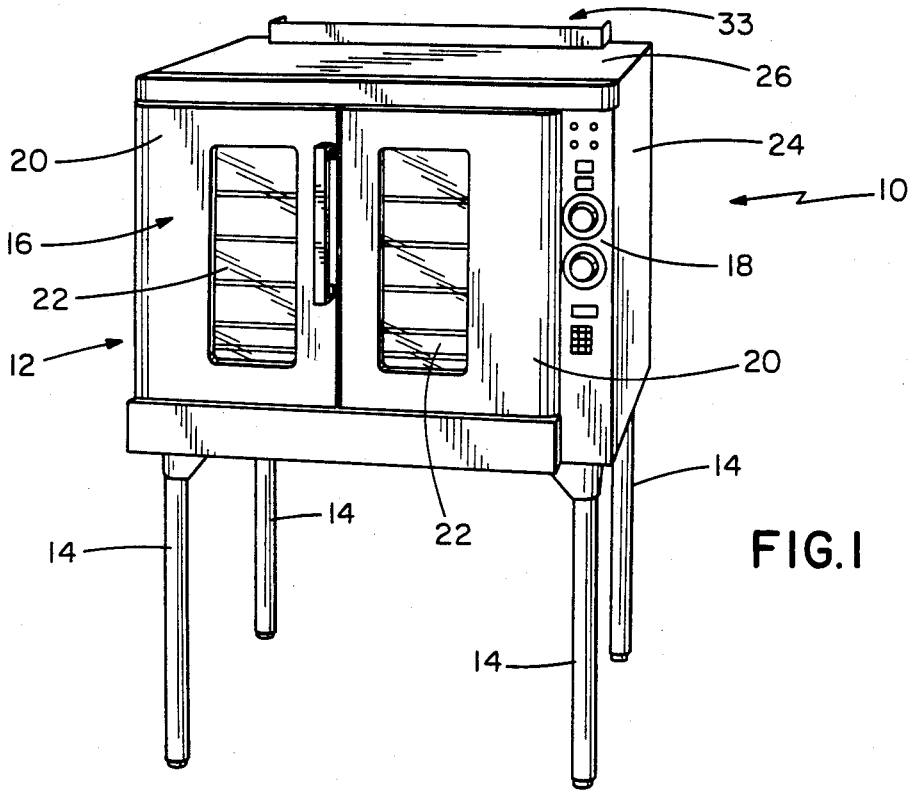
FIG. 1 is a front perspective view of a gas-fired convection oven constructed in accordance with the principles of the invention.
Figure 2:
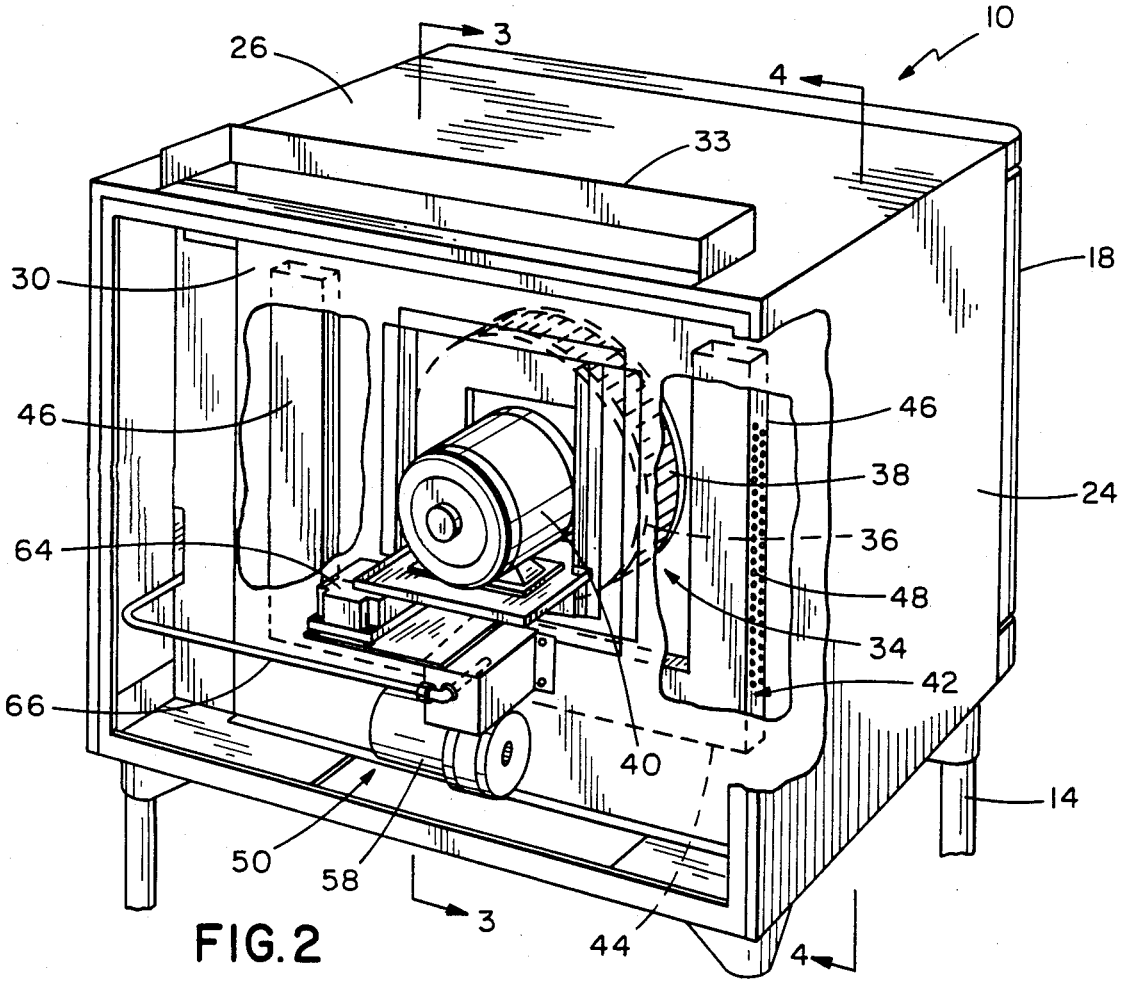
FIG. 2 is a rear perspective view, partially broken away, illustrating the internal components of the oven shown in FIG. 1.
Figure 3:
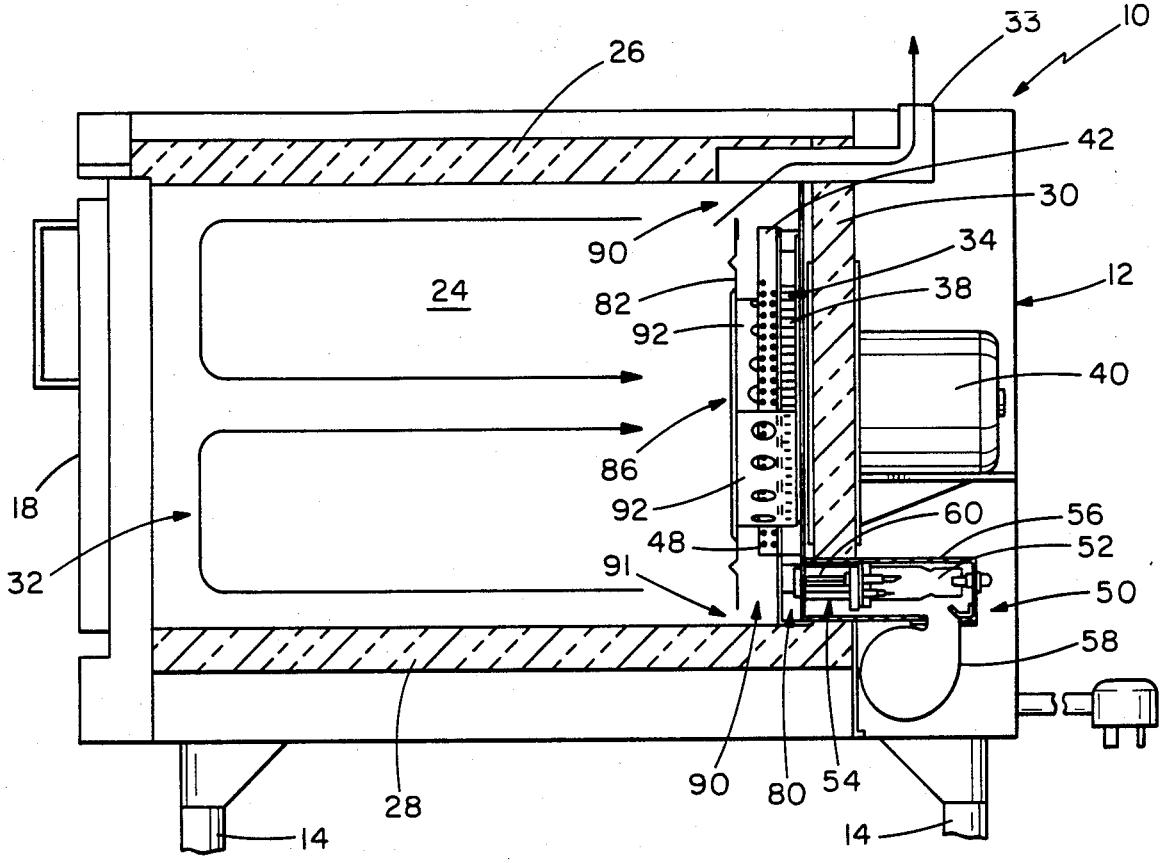
FIG. 3 is a sectional view taken along the lines 3—3 of FIG. 2.

Referring now to the drawings and initially to FIG. 1, a gas-fired convection oven, designated generally by the reference numeral 10, is illustrated as comprising an oven structure 12 supported on a plurality of legs 14. A forward face 16 of the oven structure 12 includes a suitable control panel 18 disposed to one side of a pair of hinged door members 20. The door members 20 may be provided with windows 22 for permitting viewing of the contents of the oven structure 12 during a cooking or baking cycle. As best seen in FIGS. 2 and 3, the oven structure 12 is basically of box-like construction having of pair of side walls 24, a top wall 26, a bottom wall 28 and a rear wall 30, all of which are insulated in a manner well-known in the art. The respective walls 24, 26, 28 and 30 of the oven 12 cooperate with the door members 20 to define an internal oven cavity 32. The cavity 32 is exhausted by a suitable vent 33.

Figure 4:
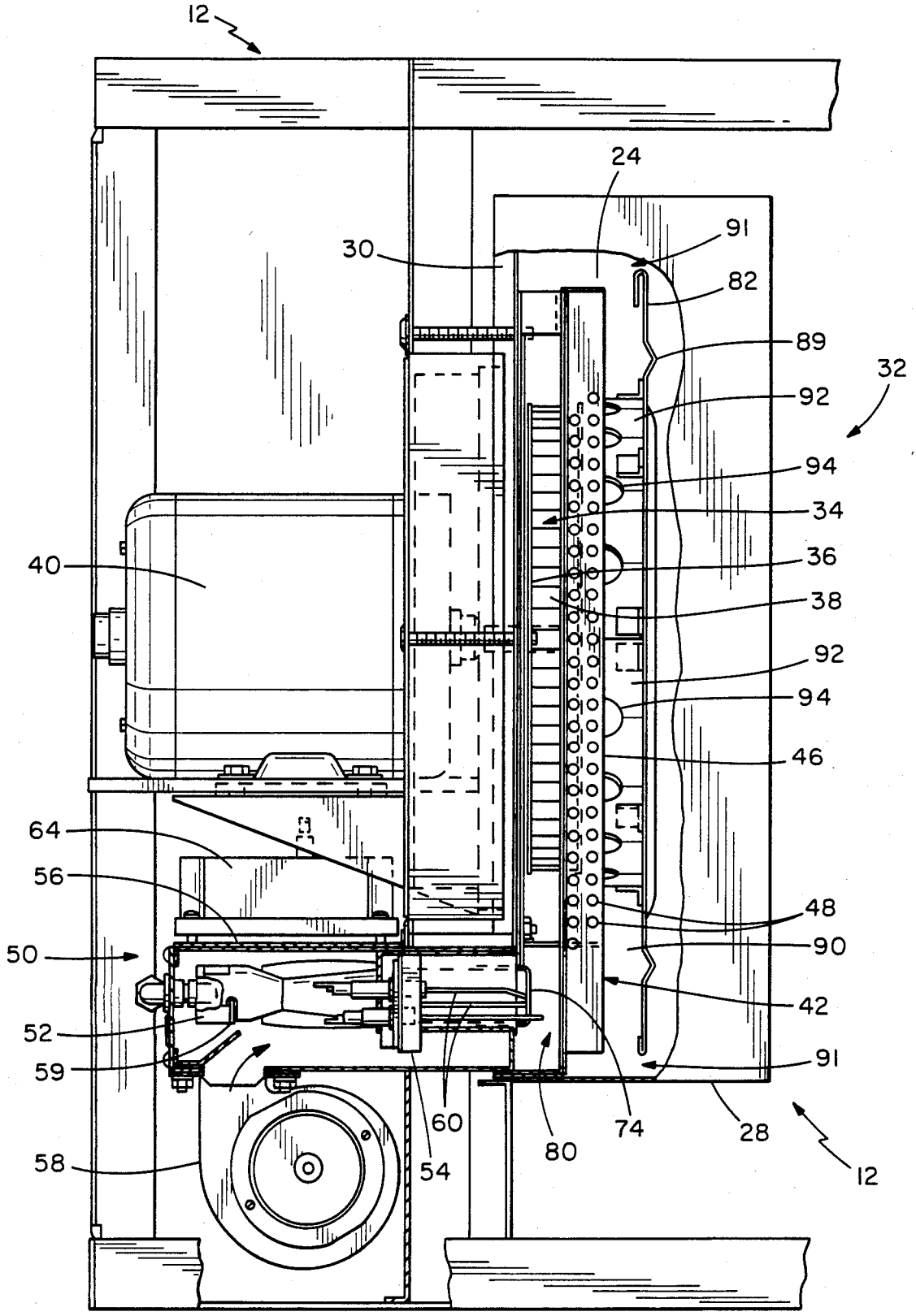
FIG. 4 is a fragmentary sectional view, partially broken away, taken primarily along the lines 4—4 of FIG. 2.

With reference now to FIGS. 2, 3 and 4, the internal components of the oven structure can be seen to include a centrifugal fan assembly 34 comprising a disc member 36 to which a plurality of blades 38 are fixed. The fan 34 is mounted for rotation on a horizontal axis driven by a suitable two-speed electric motor 40. A speed of 1725 RPM has been found suitable for all but the most delicate items, such as souffles and muffins. Such delicate items are baked better at a fan speed of 1140 RPM. The location of the fan 34 is such that the disc 36 is disposed within the oven cavity 32 in close proximity to the rear wall 30 thereof. Also positioned in close proximity to the rear wall 30 of the cavity 32 is a generally U-shaped heat exchanger 42 consisting of a hollow square tube member having a horizontally disposed base section 44 joining two vertically disposed leg sections 46 which are closed at their ends. The outwardly facing sides are closed at their ends. The outwardly facing sides of the leg sections 46 are each provided with a plurality of apertures 48 for purposes of emitting combustion by-products, as will be discussed in detail hereinafter. While the term "generally U-shaped" is used to describe the preferred form of my invention, it is intended to encompass obvious equivalents which perform the essence of the invention, e.g., C-shaped, V-shaped or the like, including inverted versions thereof, where gas enters between the oppositely disposed legs and is balanced in a manner to provide essentially equal heat distribution in both legs. In addition, while I prefer in this particular embodiment to place the heat exchanger 42 on the rear wall, the oven 12 may b provided with the same on one of the side walls where unit width is not a concern.

Figure 7:
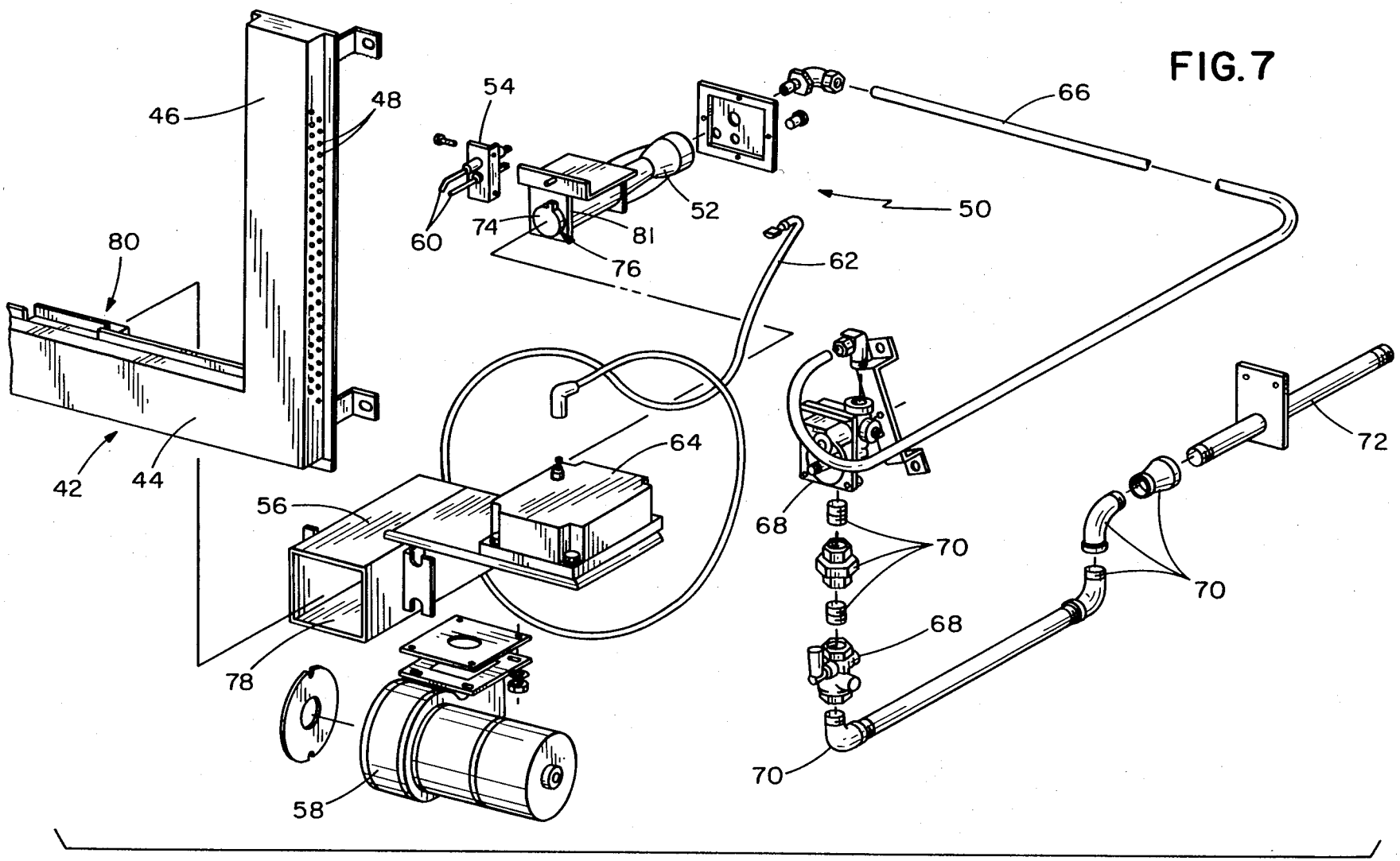
FIG. 7 is an exploded perspective view of the ignition and burner components of the oven illustrated in FIG. 1.

In order to provide for heating of the oven cavity 32, the oven structure 12 includes a gas-fired power jet burner assembly, designated generally by the reference numeral 50. The burner assembly 50 is mounted beneath the motor 40 external to the oven cavity 32 and, as best seen in the exploded view of FIG. 7, comprises a burner tube 52 and igniter 54 disposed within a square-tube secondary air conduit 56. Communicating with the conduit 56 is a forced-air fan 58 for supplying combustion air to the burner tube 52, by way of a slot 59 formed in the burner tube 52 side wall, and supplying air to the conduit 56 simultaneously. The igniter 54 includes a pair of electrodes 60 which are electrically connected by a cable 62 to a high voltage power source 64. The burner tube 52 receives a supply of gas through a supply line 66 which, in turn, is connected by a series of valves 68 and suitable fittings 70 to a main gas line 72. When it is desired to apply heat to the oven cavity 32, the valves 68 are opened to admit gas to the burner tube 52 while the igniter 54 is energized to ignite the gas/air mixture. A disc-like member or target 74 covers the distal end of the burner tube 52 for purposes of providing an orifice 76 and dispersing the resulting flame radially outwardly of the burner tube 52. The orifice 76 of the burner tube 52 is disposed at open end 78 of the square-tube conduit 56 which abuts the base section 44 of the heat exchanger 42 at a rectangular opening 80 provided therein. Accordingly, combustion by-products are admitted to the heat exchanger 42 from the burner assembly 50 and are directed outwardly into the leg sections 46 of the heat exchanger 42 whereupon they emit through apertures 48. A baffle plate 81 surrounds the orifice 76 of the burner tube 52 for purposes which will be described in detail, hereinafter.

Figure 6:
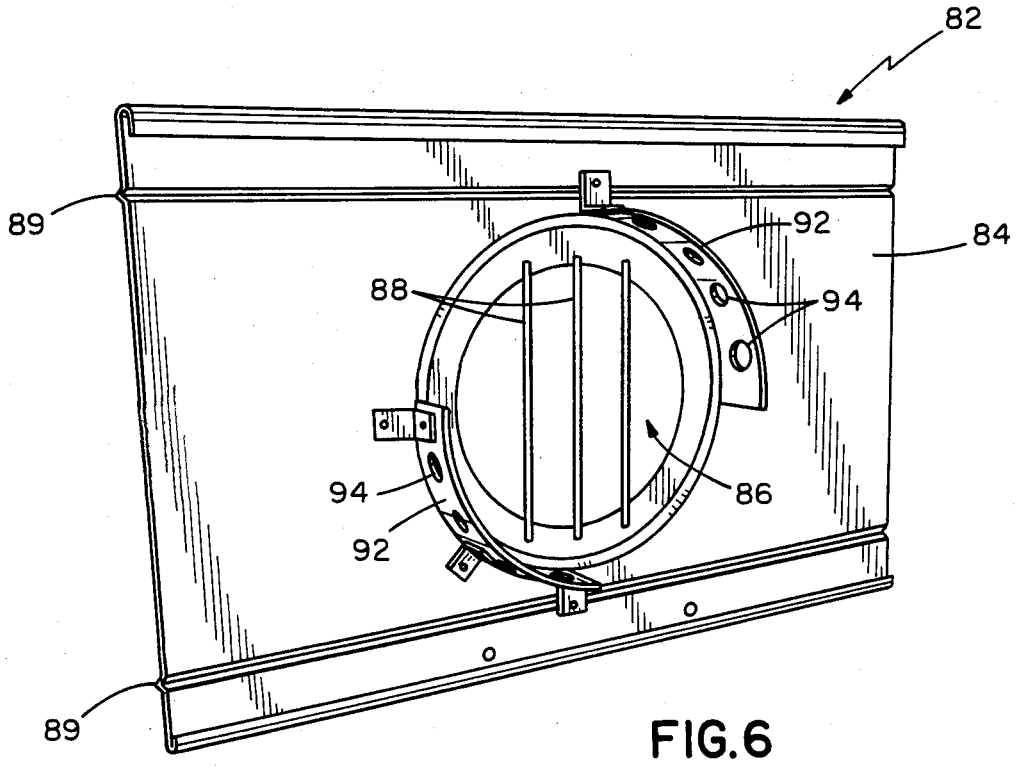
FIG. 6 is a rear perspective view of a preferred form of shroud constructed in accordance with the principles of the invention.
Figure 5:
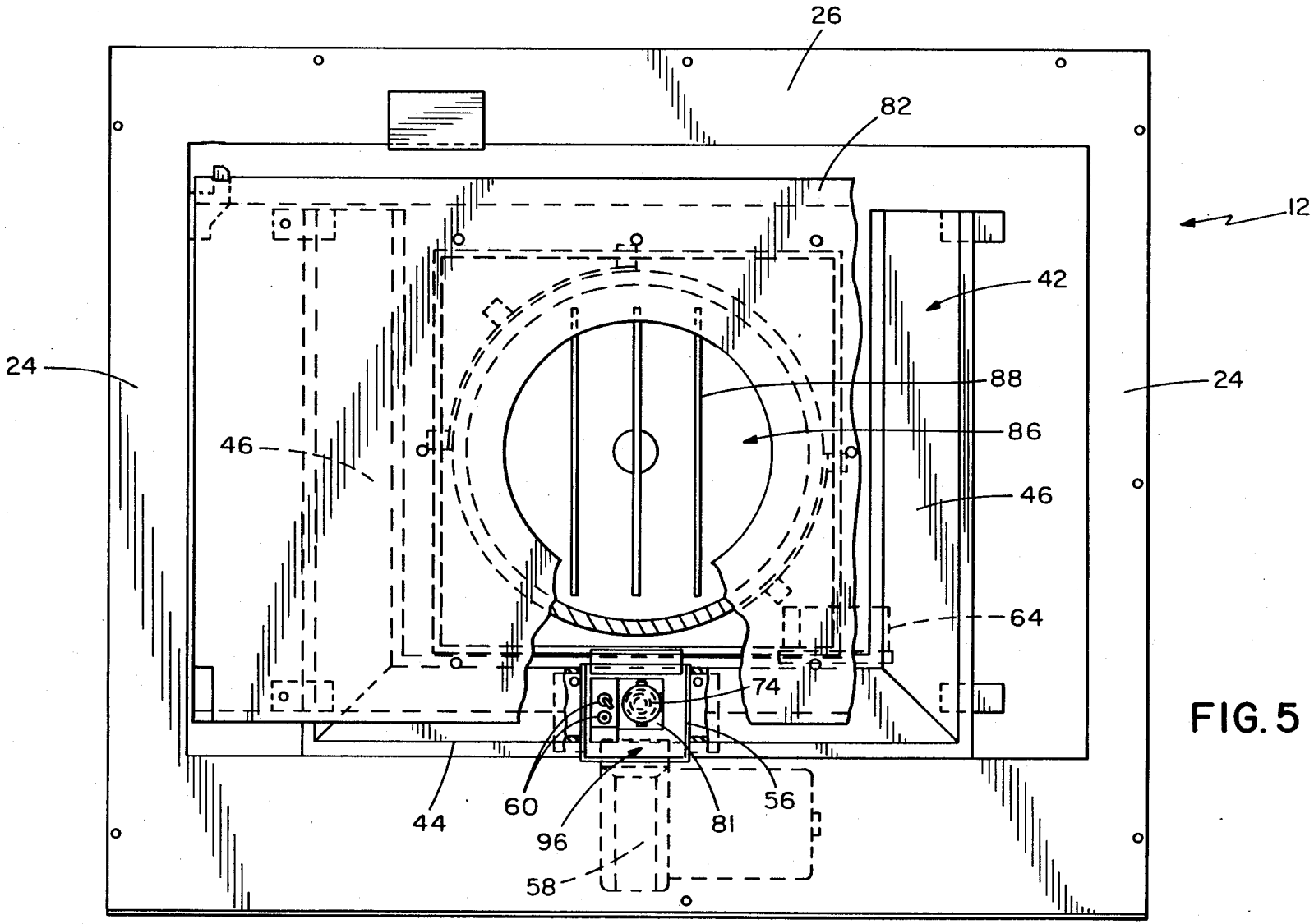
FIG. 5 is a front elevational view from the interior of the oven cavity with parts broken away.

Turning now to FIGS. 3, 5, and 6 an important feature of the invention is shown in the provision of a shroud 82 which is vertically mounted within the oven cavity 32 overlying the fan 34 and heat exchanger 42. The shroud 82 comprises a sheet-like member 84 having a central circular opening 86 which is slightly smaller in diameter than the disc 36 of the fan 34. The opening 86 is essentially coaxial with the fan 34 thereby providing an intake passage for the fan 34. A plurality of bars 88 may be fixed over the shroud opening 86 to guard against admission of foreign objects into the fan 34 intake. Ribs 89 may be formed in the shroud 82 for purposes of strengthening the sheet-like member 84 in the longitudinal direction. The position of the shroud 82 is such that it is spaced from the rear wall 30 of the cavity 32 in close proximity to the heat exchanger 42, thereby defining a narrow, vertical heat exchanging chamber 90. The size of the sheet-like member 84 is such that when the shroud 82 is in its mounted configuration, upper and lower slots 91 are formed between the shroud 82 edges and the top and bottom walls, 26 and 28, respectively, of the oven structure 12, defining air discharge openings from the chamber 90. Circulation of air within the cavity 32 is thereby provided for from the circular opening 86 of the shroud 82 through the fan 34 and out the slots 91. Consequent forced convection is, therefore, provided for within the cavity 32.

When the fan 34 is in operation, its direction of rotation together with the pitch of its blades 38 tends to create an oven cavity condition wherein high and low pressure zones exist at diametrically opposite corners of the oven cavity 32. As viewed in FIG. 5, for example, the fan 34 when rotated in a clockwise direction will tend to cause high pressure zones to exist in the upper left and lower right regions of the cavity 32. Such uneven pressurization of the cavity 32 can have a noticeable effect on the quality of the cooking operation and, in particular, on the evenness of cooking the food product placed in the oven 10. Thus, in accordance with the invention, the shroud 84 is provided with a pair of semicircular baffles 92 directed toward the rear wall 30 of the cavity 32 and disposed in close proximity to the blades 38 of the fan 34. The baffles 92 comprise plate-like members formed with a plurality of apertures 94 for permitting a limited amount of fan exhaust air to pass therethrough. Preferably, each baffle 92 extends approximately one-fourth of the circumferential distance around the shroud opening 86 and, as viewed in FIG. 5, is oriented at the upper left and lower right positions, respectively, of the opening 86. As so constructed and arranged, the baffles 92 present a partial impediment to air issuing from the fan 34 in the directions of the two cavity corners which would otherwise tend to be pressured to a greater degree than the opposite cavity corners. Accordingly, air pressure within the cavity 32 is effectively balanced and uniform cooking or baking results can be readily achieved.

Turning, once again, to FIG. 5, another important aspect of the invention can be realized in the provision of the baffle plate 81 which surrounds the orifice 76 of the burner tube 52. For proper operation of the oven 10, secondary air must be mixed with the primary gas/air mixture issuing from the burner tube 52 at the opening 80 of the heat exchanger 42. This secondary air is forced from the forced-air fan 58 through the air conduit 56 around the outside of the burner tube 52 and it mixes with the burner tube 52 gas/air supply to provide a preferred fuel-to-air ratio for efficient combustion. Oven devices having U-shaped heat exchangers would operate with low efficiency and uneven heat distribution when the combustion products entering the vertical leg portions of the heat exchanger are not balanced. This condition can occur, for example, as a result of uneven pressure zones within the air conduit surrounding the burner tube, the uneven zones being caused by air flow characteristics of the forced-air fan and air conduit arrangement. The uneven pressure zones within the air conduit can cause an air curtain effect at the opening to the heat exchanger which prevents even distribution of combustion by-products to the legs of the heat exchanger. The result is inefficient burning of fuel and unequal heating of the legs of the heat exchanger whereby heat transfer from the cavity air to the product is less efficient.

In accordance with the invention, unequal distribution of combustion by-products to the legs 46 of the heat exchanger 42 is eliminated by the baffle plate 81. The baffle plate 81 is configured such that it covers the central portion of the secondary air conduit 56 opening and, in cooperation with the igniter 54, forms a reverse L-shaped slot 96. As viewed in FIG. 5, one leg of the slot 96 provides an opening to the air conduit 56 disposed to the right of the burner tube orifice 76. The second leg of the slot 96 provides a conduit opening disposed underneath the orifice 76. By this configuration, secondary air issuing from the conduit 56 is concentrated to one side of the burner orifice 76 establishing an air curtain restriction for preventing excessive combustion by-products from entering the adjacent leg 46 of the heat exchanger 42. Thus, the pressure of the combustion products entering both legs 46 of the heat exchanger 42 is effectively balanced.

OPERATION

Operation of the invention in terms of cooking or baking efficiency is illustrated by the following examples of comparative tests which are not to be construed as limiting the present invention, the scope of which is defined by the appended claims. In some instances the oven at the present invention may have a slightly longer cooking time at lower temperature, but still consume less gas than competitive units presently available.

EXAMPLE 1

No-load performance of an oven constructed in accordance with the principles of the invention was compared against the no-load performance of a prior art forced-air convection oven commonly available for commercial cooking and baking applications. From a cold oven to 350° F., the instant oven consumed 4.57 cubic feet of gas over a time period of 7.37 minutes. The prior art unit consumed 11.15 cubic feet of gas over a time period of 11.46 minutes. The gas volume consumption stabilized at 350° F. was 4.4 cubic feet per hour for the instant oven in comparison with 12.76 cubic feet per hour for the prior art unit.

EXAMPLE 2

In a product performance test, three rolled beef roasts were cooked until a temperature of 155° F. was reached at the center of the roasts. Gas usage for the oven of the instant invention was 31.33 cubic feet over a cooking time of 3 hours, 39 minutes while the prior art unit consumed 52.07 cubic feet of gas over a cooking time of 3 hours, 49 minutes.

EXAMPLE 3

Sixty pieces of quartered chicken were baked in five pans for 30 minutes at 350° F. The oven of the instant invention used 16.85 cubic feet of gas while the prior art oven consumed 25.58 cubic feet of gas.

EXAMPLE 4

Five full-size sheet cakes were baked in each oven to essentially the same doneness. The oven of the instant invention used 7.69 cubic feet of gas over 17 minutes while the prior art oven consumed 11.6 cubic feet of gas over 17 minutes.

EXAMPLE 5

Thirty frozen pies (29 ounce) were baked in each oven at 350° F. for 45 minutes. The oven of the instant invention consumed 20 cubic feet of gas while the prior art oven used 30.37 cubic feet.

EXAMPLE 6

Twenty-four one-pound loaves of white bread were baked in each oven at 325° F. for 30 minutes. The oven of the instant invention consumed 8.08 cubic feet of gas while the prior art unit used 13.70 cubic feet of gas.

It can now be appreciated that a gas-fired convection oven constructed in accordance with the principles of the invention offers significant advantages in terms of energy efficiency over prior art ovens heretofore available for commercial cooking and baking applications. For example, the foregoing comparative test results indicate an approximate 30% to 40% savings in gas consumption during standard cooking and baking operations. These results are enhanced by the U-shaped heat exchanger 42 of the instant invention wherein the distribution of combustion by-products to the two legs 46 of the heat exchanger 42 is uniformly balanced. Thus, each heat exchanger leg 46 contributes equally to the amount of heat transferred to the oven cavity air. Such even distribution is accomplished by the baffle plate 81 disposed at the burner tube orifice 76 which creates an L-shaped air conduit opening 96 for balancing the combustion by-products issuing from the secondary air conduit 56 into the legs 46 of the heat exchanger 42. Moreover, air pressure distribution within the cavity 32, itself, is equalized against disparate high and low pressure zones by the baffle members 92 provided on the shroud 82 which overlies the heat exchanger 42 and fan 34. Equalization of air pressure within the oven cavity 32 allows for the efficient and uniform transfer of heat from the heat exchanger 42 to the product placed within the oven.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed as new and desired to be secured under Letters Patent of the United States is:

1. A gas-fired convection oven comprising:

a cooking cavity surrounded by insulated side, top, bottom and rear walls and a front access door, all of which together enclose the cavity when cooking;

a centrifugal fan on a horizontal axis essentially centrally located on one of said side or rear walls and motor means on the opposite side of said one wall for rotating said fan during cooking;

a vertical shroud mounted adjacent the side of said fan opposite from said one wall and forming with said one wall a relatively narrow, vertical heat exchanging chamber within said cavity, at least two opposed outer edges of said shroud being spaced from adjacent walls to provide air passage slots thereat, said shroud having a central opening coaxial with and essentially smaller than a fan for inducing air flow from said cavity into an inlet at the center of the fan;

a heat exchanger comprising a generally U-shaped hollow tube extending along at least three walls within the heat exchanging chamber, said heat exchanger having an inlet entering through said one wall along the bottom portion of said U-shaped tube;

a plurality of outwardly-directed jets on the leg portions of the heat exchanger and extending essentially throughout the length thereof;

a power jet burner including a motor-driven forced-air fan, a burner tube, an igniter and a gas/air mixing inlet to said burner tube, the air for said gas/air mixture being supplied from the exterior of said cavity for gas ignition at the inlet to the heat exchanger;

an air passageway conduit surrounding the burner tube adjacent the heat exchanger inlet and communicating with said forced-air fan for directing secondary air around said burner tube and into the inlet; and means for baffling said secondary air at the inlet to said heat exchanger in a manner generally balancing the flow of combustion products from said burner through both legs of the heat exchanger.

2. An oven according to claim 1 wherein the centrifugal fan is driven in a direction normally tending to create low pressure areas in one lower and a diametrically opposite upper corner of the heat exchanging chamber and high pressure areas in the remaining corners thereof, said oven including second baffle means on radially opposite sides of said centrifugal fan for increasing the pressure in the low pressure areas while simultaneously reducing the pressure in the high pressure areas to equalize the heated air circulated through said cavity and said heat exchanging chamber as it passes through said slots and returns to the centrifugal fan inlet.

3. An oven according to claim 2 wherein said second baffle means comprises a pair of semi-circular plate members mounted to said shroud in proximity to said fan and extending circumferentially at least partially around said disc of said fan.

4. An oven according to claim 3 wherein said plate members are provided with apertures formed therethrough for providing limited flow of air through said plate members.

5. An oven according to claim 3 wherein each plate member extends around said disc for approximately one-fourth the circumference of said disc.

6. An oven according to claim 5 wherein said second baffle means are disposed in proximity to the corners of said cavity in which said fan would normally tend to create high pressure areas.

7. An oven according to claim 1 wherein said means for baffling said secondary air provides a generally L-shaped opening to said air passageway conduit at the inlet to said heat exchanger.

8. A convection oven comprising:

a cooking cavity, generally rectangular in cross section and surrounded by insulated side, top, bottom and rear walls and a front access door all of which all together enclose the cavity when cooking;

a heat exchanging chamber within said cavity located at one of said side or rear walls;

a unidirectional centrifugal fan rotatable on a horizontal axis located centrally on said one wall, said one wall forming one side of said heat exchanging chamber;

motor means on the exterior side of said one wall for driving said fan during cooking;

a generally rectangular vertical shroud mounted adjacent the fan on the opposite side thereof from said one wall, at least two opposed outer edges of said shroud being spaced from adjacent cavity walls to provide air passage slots at said two outer edges;

said shroud having a central opening coaxial with and essentially smaller than the fan for inducing air flow from said cavity into a fan inlet at the center of the fan;

heat exchanger means within the heat exchanging chamber for heating said cavity, said means being located generally planar with and radially outward of the fan whereby the fan directs air across the heat exchanger means toward the outer edges of the chamber and then through said slots to the cavity; and baffle means mounted on said shroud within the heat exchanging chamber, comprising a pair of spaced arcuate plates adjacent the central opening and being located on opposite sides thereof, said plates being arranged to decrease air pressure from the fan within the heat exchanger chamber radially outwardly of the plates and thereby allow for an increase in air pressure radially outward where flow of air from the centrifugal fan is unobstructed by the plates, whereby maximum pressure is created by the fan for the full lengths of the air passage slots, to direct air flow essentially along the walls parallel to each corresponding air passage slot and then return centrally from the wall opposite to the heat exchanging chamber toward and into the central opening for continued air flow recirculation through the cavity by said fan during cooking.

* * * * *